US011213128B2

(12) United States Patent
Robinson et al.

(10) Patent No.: US 11,213,128 B2
(45) Date of Patent: Jan. 4, 2022

(54) MOTION FURNITURE MECHANISM WITH PRE-ALIGNED LINKAGE MEMBER

(71) Applicant: Ashley Furniture Industries Inc., Arcadia, WI (US)

(72) Inventors: Jeremy Robinson, Pontotoc, MS (US); Rigoberto Marquez, New Albany, MS (US); James Floyd, Baldwyn, MS (US)

(73) Assignee: Ashley Furniture Industries Inc., Arcadia, WI (US)

( * ) Notice: Subject to any disclaimer, the term of this patent is extended or adjusted under 35 U.S.C. 154(b) by 31 days.

(21) Appl. No.: 16/419,053

(22) Filed: May 22, 2019

(65) Prior Publication Data

US 2019/0269243 A1 Sep. 5, 2019

Related U.S. Application Data

(62) Division of application No. 15/642,461, filed on Jul. 6, 2017, now Pat. No. 10,750,869.

(51) Int. Cl.
*A47C 1/034* (2006.01)

(52) U.S. Cl.
CPC ..... *A47C 1/0345* (2013.01); *Y10T 29/49826* (2015.01)

(58) Field of Classification Search
CPC .. A47C 1/0345; A47C 1/034; Y10T 29/49826
See application file for complete search history.

(56) References Cited

U.S. PATENT DOCUMENTS 6,893,085 B2 5/2005 LaPointe et al.
6,896,323 B2 5/2005 LaPointe et al.
(Continued)

FOREIGN PATENT DOCUMENTS

CN 103565157 A 2/2014
CN 203458064 U 3/2014
(Continued)

OTHER PUBLICATIONS

PCT International Search Report for PCT App. No. PCT/US2018/041079 dated Nov. 6, 2018, 9 pages.
(Continued)

*Primary Examiner* — Lee A Holly
(74) *Attorney, Agent, or Firm* — Waller Lansden Dortch & Davis LLP; Matthew C. Cox

(57) ABSTRACT

A motion furniture side mechanism includes a side plate and a pivotable swing arm pre-aligned with the side plate for insertion of a driver tube using an automated or manual assembly operation. The swing arm includes a pivotable driver arm, and a driver tube socket is defined on the driver arm. One or more bushings disposed between the side plate and the swing arm or driver arm provides a mechanical retainer to prevent the swing arm or driver arm from becoming inadvertently angularly misaligned prior to assembly. The pre-aligned side mechanism allows automated insertion of a driver tube without the need to identify a misaligned linkage or re-align a linkage prior to driver tube insertion. A method of assembly furniture includes providing a side mechanism with a pre-aligned linkage member such as a swing arm or driver arm positioned for driver tube insertion.

5 Claims, 10 Drawing Sheets

(56) References Cited

U.S. PATENT DOCUMENTS

| | | | | |
|---|---|---|---|---|
| 7,699,394 | B2 | 4/2010 | Humer et al. | |
| 7,997,644 | B2 | 8/2011 | Hoffman et al. | |
| 8,016,348 | B2 | 9/2011 | Hoffman et al. | |
| 8,113,574 | B2 | 2/2012 | Hoffman et al. | |
| 8,297,693 | B2 | 10/2012 | Hoffman et al. | |
| 8,366,188 | B2 | 2/2013 | Adams et al. | |
| 8,398,165 | B2 | 3/2013 | Lawson | |
| 8,398,168 | B2 | 3/2013 | Lawson | |
| 8,408,654 | B2 | 4/2013 | Jones et al. | |
| 8,459,732 | B2 | 6/2013 | LaPointe et al. | |
| 8,506,009 | B2 | 8/2013 | LaPointe et al. | |
| 8,608,240 | B2 | 12/2013 | Marshall et al. | |
| 8,833,844 | B2 | 9/2014 | LaPointe et al. | |
| 8,845,014 | B2 | 9/2014 | Wong | |
| 9,314,099 | B2 | 4/2016 | Huang et al. | |
| 2001/0044961 | A1 | 11/2001 | Epstein et al. | |
| 2004/0208695 | A1 | 10/2004 | LaPointe | |
| 2004/0256902 | A1 | 12/2004 | LaPointe et al. | |
| 2008/0217975 | A1* | 9/2008 | Casteel | A47C 1/0352 297/261.1 |
| 2009/0025142 | A1 | 1/2009 | Grossman et al. | |
| 2010/0237678 | A1 | 9/2010 | Leng | |
| 2011/0175426 | A1 | 7/2011 | Lawson | |
| 2012/0096975 | A1 | 4/2012 | Du et al. | |
| 2012/0304380 | A1 | 12/2012 | Jin | |
| 2014/0070585 | A1 | 3/2014 | LaPointe | |
| 2014/0091601 | A1 | 4/2014 | Breen et al. | |
| 2015/0033885 | A1 | 2/2015 | Kristen | |
| 2015/0125102 | A1* | 5/2015 | Blunier | B60G 5/02 384/154 |
| 2016/0058195 | A1 | 3/2016 | Huang et al. | |
| 2017/0347796 | A1* | 12/2017 | Lapointe | A47C 1/034 |

FOREIGN PATENT DOCUMENTS

| | | | |
|---|---|---|---|
| CN | 203538794 | U | 4/2014 |
| CN | 103932521 | A | 7/2014 |
| CN | 203852053 | U | 10/2014 |
| KR | 1020140058606 | A | 5/2014 |
| WO | 2007093181 | A1 | 8/2007 |
| WO | 2008118276 | A1 | 10/2008 |
| WO | 2010036238 | A1 | 4/2010 |
| WO | 2015172602 | A1 | 11/2015 |

OTHER PUBLICATIONS

PCT International Search Report for PCT App. No. PCT/US2018/046731 dated Nov. 29, 2018, 15 pages.
PCT International Search Report for PCT App. No. PCT/US2018/046546 dated Nov. 29, 2018, 11 pages.
Abstract of KR 10-2014-0058606, La-Z-Boy, Incorporated, 1 page.
Abstract of CN 103565157, Ruimai Machinery Technology Wujiang Co Ltd., 11 pages.
Abstract of CN 103932521, Huang Xiaowei, 14 pages.
Abstract of CN 203458064, Ruimai Machinery Technology Wujiang Co Ltd., 13 pages.
Abstract of CN 203538794, Ruimai Machinery Technology Wujiang Co Ltd., 8 pages.
Abstract of CN 203852053, Huanx Xiaowei, 13 pages.

* cited by examiner

MOTION FURNITURE MECHANISM WITH PRE-ALIGNED LINKAGE MEMBER

CROSS-REFERENCES TO RELATED APPLICATIONS

This application is a divisional of U.S. patent application Ser. No. 15/642,461 filed Jul. 6, 2017 entitled MOTION FURNITURE MECHANISM WITH PRE-ALIGNED LINKAGE MEMBER, which is hereby incorporated by reference in its entireties.

A portion of the disclosure of this patent document contains material that is subject to copyright protection. The copyright owner has no objection to the reproduction of the patent document or the patent disclosure, as it appears in the U.S. Patent and Trademark Office patent file or records, but otherwise reserves all copyright rights whatsoever.

STATEMENT REGARDING FEDERALLY SPONSORED RESEARCH OR DEVELOPMENT

Not Applicable.

REFERENCE TO SEQUENCE LISTING OR COMPUTER PROGRAM LISTING APPENDIX

Not Applicable.

BACKGROUND

The present disclosure relates generally to furniture and more particularly to motion furniture with opposing side mechanisms.

Conventional motion furniture generally includes a frame having opposing side mechanisms joined together by cross-members that span between the side mechanisms. Each side mechanism includes a number of rigid linkage members connected at pivoting joints. During use, the side mechanisms may be actuated manually by a user or via an electromechanical drive unit on the frame. When the side mechanisms are actuated, the linkage members pivot and/or translate relative to one another, leading to a desired movement of the furniture. Such desired movements often include rocking, reclining, or raising or lowering a headrest or ottoman.

The side mechanisms in conventional motion furniture are commonly mirror images of each other, and the side mechanisms often move simultaneously in identical ranges of motion. To accommodate this simultaneous movement, cross-members spanning between the side mechanisms maintain a horizontal connection between opposing linkage members on opposite sides of the frame. Thus, when a cross-member is pushed, pulled or rotated during an actuation operation, corresponding motion is simultaneously imparted on both opposing side mechanisms. One type of cross-member used to impart motion is referred to as a drive tube.

Cross-members are typically secured at one end to the first side mechanism and at the opposite end to the second side mechanism. During assembly of the frame, each side mechanism is positioned upright in a jig or template at a desired orientation and spacing, and cross members are attached to the side mechanisms using any suitable attachment mode, including for example manual fixation of the cross-member to the side mechanisms using fasteners or a mechanical interference fit. Alternatively, during frame assembly, one or more cross-members may be installed spanning between opposing side members using automated industrial robots having suitable end of arm tooling to affix the cross-members to each side mechanism at the appropriate locations.

During both manual and automated frame assembly for motion furniture, it is generally desirable to reduce the number of physical operations any worker or automated robot must perform to further optimize the throughput and efficiency of the assembly line. For this reason, conventional side mechanisms are often configured in a suitable orientation for cross-member attachment prior to packaging and delivery to the assembly line. Upon delivery to the assembly line, it is desirable for a worker or an automated robot to be able to pick up first and second side mechanism units and place each unit on a template or jig for cross-member attachment without having to perform unnecessary operations on the side mechanism. However, in many situations, side mechanisms provided for frame assembly do not have uniformly aligned linkages across the entire mechanism. This problem requires workers or automated robots to identify any misalignments of linkage members in each side mechanism, and to reposition the misaligned linkage members in the proper orientation before proceeding with cross-member installation.

For example, in particular types of side mechanisms for motion furniture, some swing linkage members are often freely pivotable in the general plane of the side mechanism. These types of side mechanisms are delivered from the manufacturer with the swing linkage in a random orientation that is typically non-uniform across a batch. The swing linkage or an associated member often includes a socket that must be aligned with one or more corresponding holes on the side mechanism for insertion of a cross-member such as a drive tube. When the swing linkage is misaligned, the drive tube socket isn't aligned with its corresponding clearance holes as required for cross-member insertion. Thus, the cross-member cannot be installed until the swing linkage is properly rotated to its intended angular position such that the socket is aligned with all corresponding clearance to receive the cross-member.

The process of identifying misaligned linkage members in side mechanisms prior to cross-member installation is time consuming, requires additional steps in the assembly line, and reduces assembly line efficiency. Additionally, the task of identifying and re-positioning a linkage member such as a pivotable swing arm may be impossible to perform using automated industrial robots. In such circumstances, an automated frame assembly line may require manual swing arm alignment by a worker prior to subsequent automated operations by a robot. However, requiring a manual alignment step in an otherwise automated frame assembly operation is inefficient and undesirable.

What is needed are improvements in devices and methods for frame assembly in motion furniture.

BRIEF SUMMARY

This Brief Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

One aspect of some embodiments of the present invention provides a furniture apparatus including a side mechanism having a side plate with a clearance hole and a pivotable linkage with a drive tube socket, wherein the linkage and the side mechanism are pre-aligned.

Another aspect of some embodiments of the present invention provides a side mechanism including one or more bushings positioned between the side plate and the pivotable linkage to retain the linkage in a desired alignment relative to the side plate.

Yet another aspect of some embodiments of the present invention provides a method of assembling furniture including providing a side mechanism with a pre-aligned linkage member such as a swing arm or driver arm positioned for driver tube insertion.

A further aspect of some embodiments of the present invention provides an improved mechanism for motion furniture configured with a pre-aligned linkage to facilitate automated assembly using one or more automated industrial robots.

Numerous other objects, advantages and features of the present disclosure will be readily apparent to those of skill in the art upon a review of the following drawings and description of a preferred embodiment.

DETAILED DESCRIPTION

Figure 1:
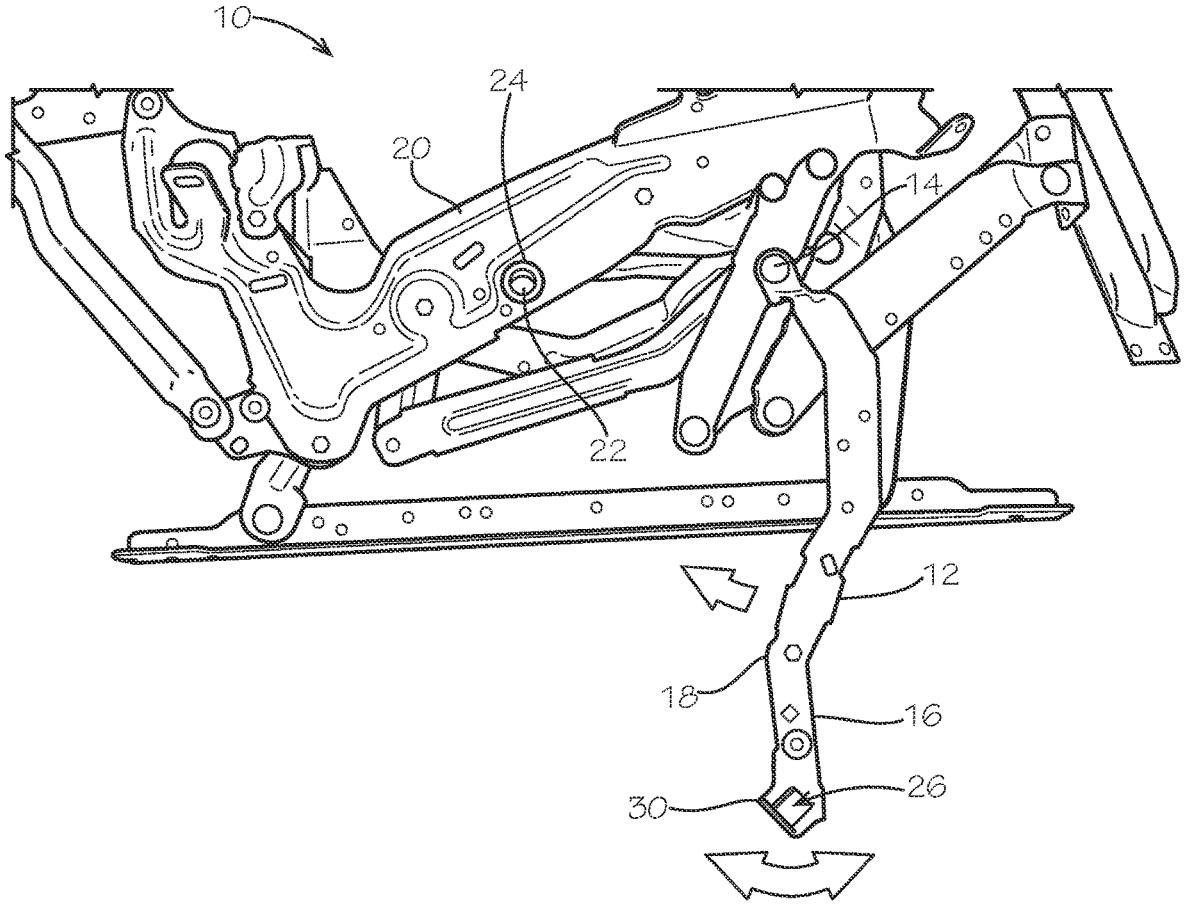
FIG. 1 (PRIOR ART)
FIG. 1 is a plan view of an embodiment of a conventional side mechanism for a furniture frame with a pivotally attached swing arm and a driver arm pivotally attached to the swing arm, wherein the swing arm and driver arm are misaligned relative to a driver tube hole in the side mechanism.

While the making and using of various embodiments of the present invention are discussed in detail below, it should be appreciated that the present invention provides many applicable inventive concepts that are embodied in a wide variety of specific contexts. The specific embodiments discussed herein are merely illustrative of specific ways to make and use the invention and do not delimit the scope of the invention. Those of ordinary skill in the art will recognize numerous equivalents to the specific apparatus and methods described herein. Such equivalents are considered to be within the scope of this invention and are covered by the claims.

In the drawings, not all reference numbers are included in each drawing, for the sake of clarity. In addition, positional terms such as "upper," "lower," "side," "top," "bottom," etc. refer to the apparatus when in the orientation shown in the drawing, or as otherwise described. A person of skill in the art will recognize that the apparatus can assume different orientations when in use.

Referring now to the drawings, FIG. 1 illustrates an example of a conventional side mechanism 10 for a frame on a piece of motion furniture. In a frame, side mechanism 10 would be positioned opposite a mirror image side mechanism, and multiple cross-members and a drive tube would span the gap between the opposing side mechanisms. During assembly, the opposing side mechanisms are generally aligned and held in place in spaced relation to each other on a jig or template. A worker or an automated robot would then install the horizontal drive tube and horizontal cross members to connect the opposing side mechanisms together.

During the assembly process, a conventional side mechanism 10 is provided with a swing arm 12 that is generally pivotable relative to the side mechanism 10 about a swing arm joint 14. The swing arm 12 may rotate about the swing arm joint 14 in a complete circle or an incomplete arc.

A driver arm 16 is pivotally attached to the distal end of swing arm 12 at a driver arm joint 18. Driver arm 16 is generally shorter than swing arm 12 in some embodiments. Driver arm 16 has at its distal end opposite driver arm joint 18 a driver tube socket 26. Driver tube socket 26 is shaped to receive an axial end of a driver tube 34, shown for example in FIG. 3. Driver tube 34 includes a non-circular cross-sectional profile in some embodiments. Driver tube socket 26 matches the local cross-sectional profile of driver tube 34 in some embodiments to provide an engagement between driver tube 34 and driver arm 16 allowing driver tube 34 to impart torque and angular motion on driver arm 16.

Figure 2:
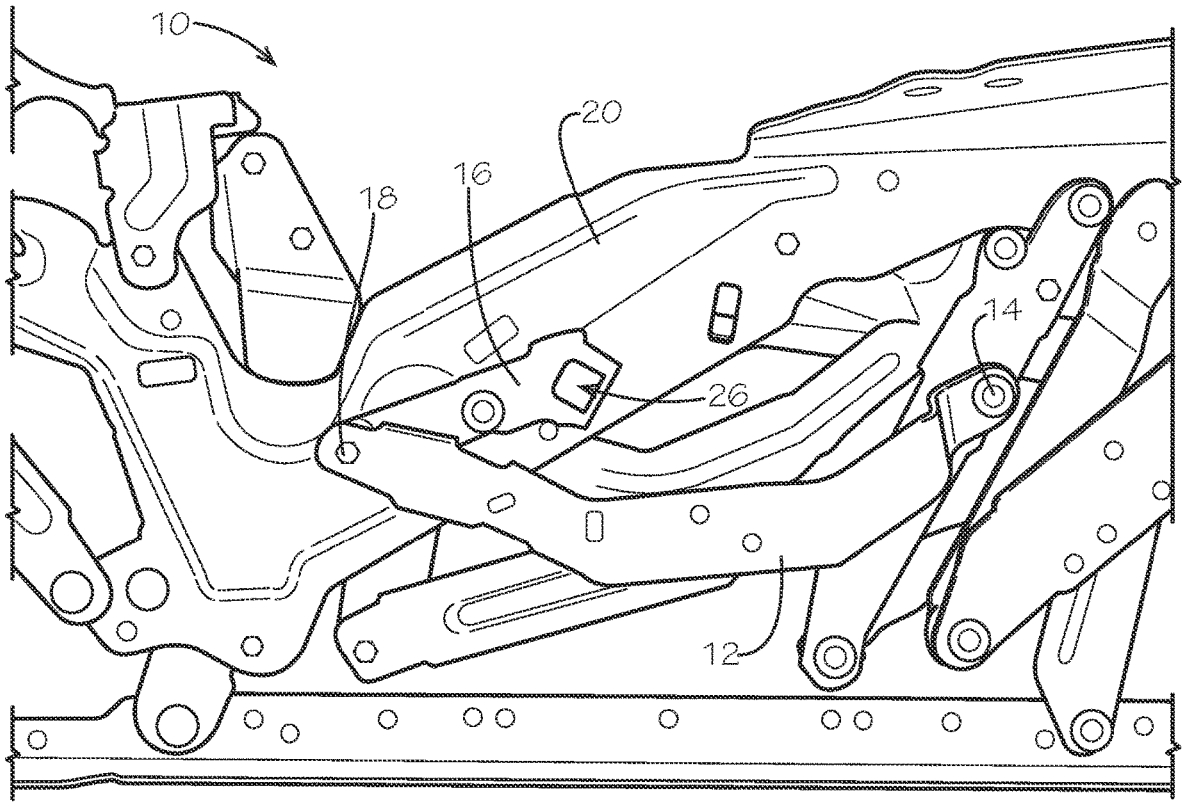
FIG. 2 (PRIOR ART)
FIG. 2 is a plan view of an embodiment of a conventional side mechanism for a furniture frame with the swing arm and driver arm in proper alignment with the driver tube hole.

As shown in FIG. 1 and FIG. 2, side mechanism 10 also includes a side linkage, or side plate 20 forming a chassis on side mechanism 10 upon which additional linkage members are mounted. Side plate 20 includes a driver tube hole 22 in some embodiments. Driver tube hole 22 provides a clearance hole allowing passage of driver tube 34 through side plate 20. A side plate bushing 24 is inserted in driver tube hole 22 on side plate 20 in some embodiments. Side plate bushing 24 includes a plastic or non-metal material in some embodiments to provide a wear surface between driver tube 34 and side plate 20. Side plate bushing 24 also assists with alignment of driver tube 34 with driver arm socket 26 during assembly in some embodiments.

Figure 3:
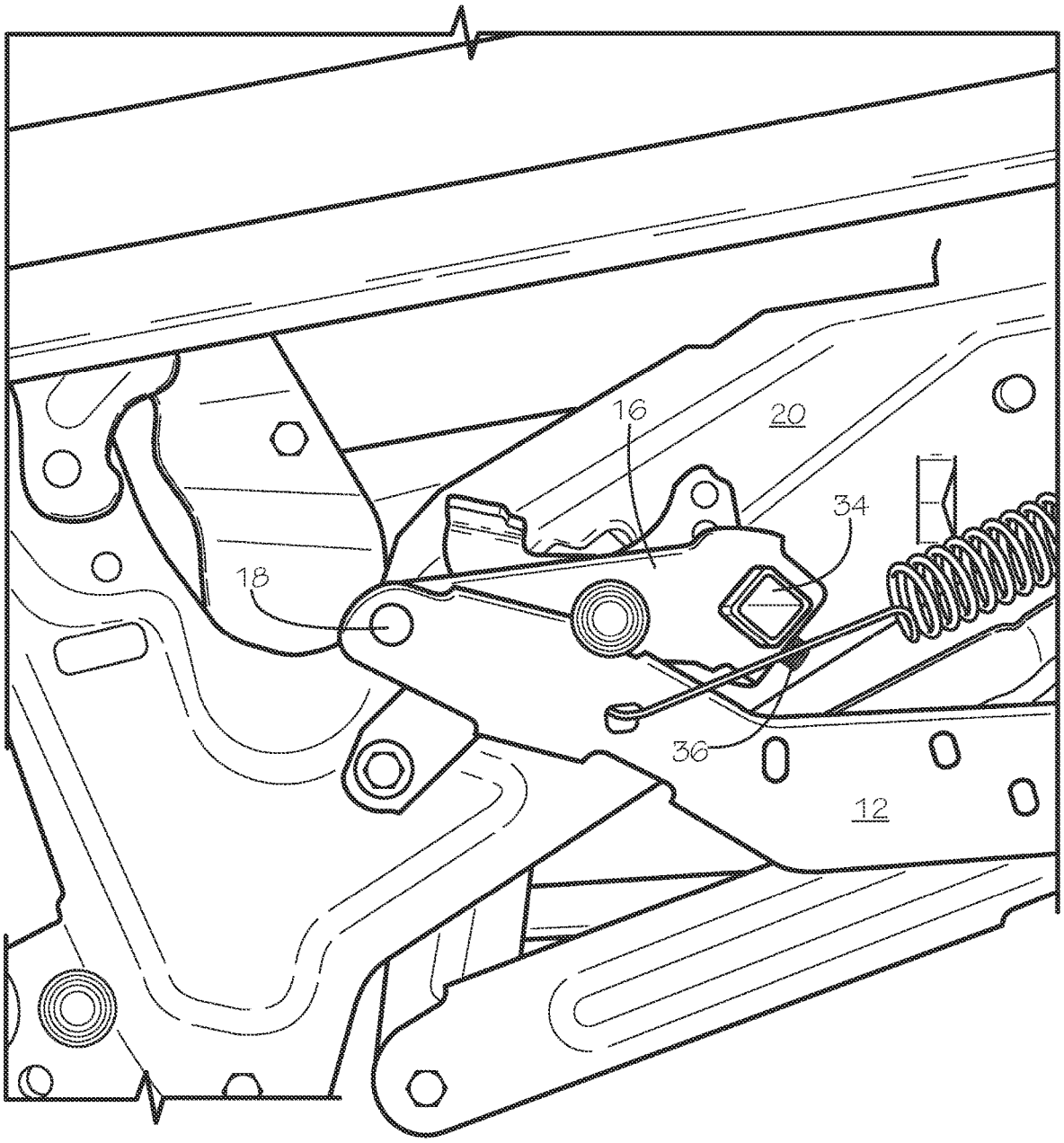
FIG. 3 (PRIOR ART)
FIG. 3 is a plan view of the embodiment of a conventional side mechanism for a furniture frame of FIG. 2 with a square driver tube installed through the driver tube hole into the driver arm socket.

Referring further to FIG. 1, swing arm 12 is shown in a misaligned orientation in a conventional device. Swing arm 12 is misaligned because driver arm 16 is not in a position allowing driver arm socket 26 to be co-axially aligned with driver tube hole 22 on side plate 20. In order for the frame to be assembled, driver tube 34 must be able to extend through driver tube hole 22 and into driver arm socket 26, as shown in FIG. 2 and FIG. 3. However, when swing arm 12 is in a misaligned position, installation of driver tube 34 is not possible. Thus, when swing arm 12 is misaligned, as shown in FIG. 1 using a conventional side mechanism 10, a user must manually reposition swing arm 12 and driver arm 16 into the proper position shown in FIG. 2 where driver socket 26 is co-axially aligned with driver tube hole 22. This manual realignment of swing arm 12 and driver arm 16 complicates efforts to automate assembly of a frame using opposing side mechanisms because it is generally difficult to configure industrial robots with end of arm tooling to identify the misalignment and to properly realign the swing arm and driver arm.

Figure 4:
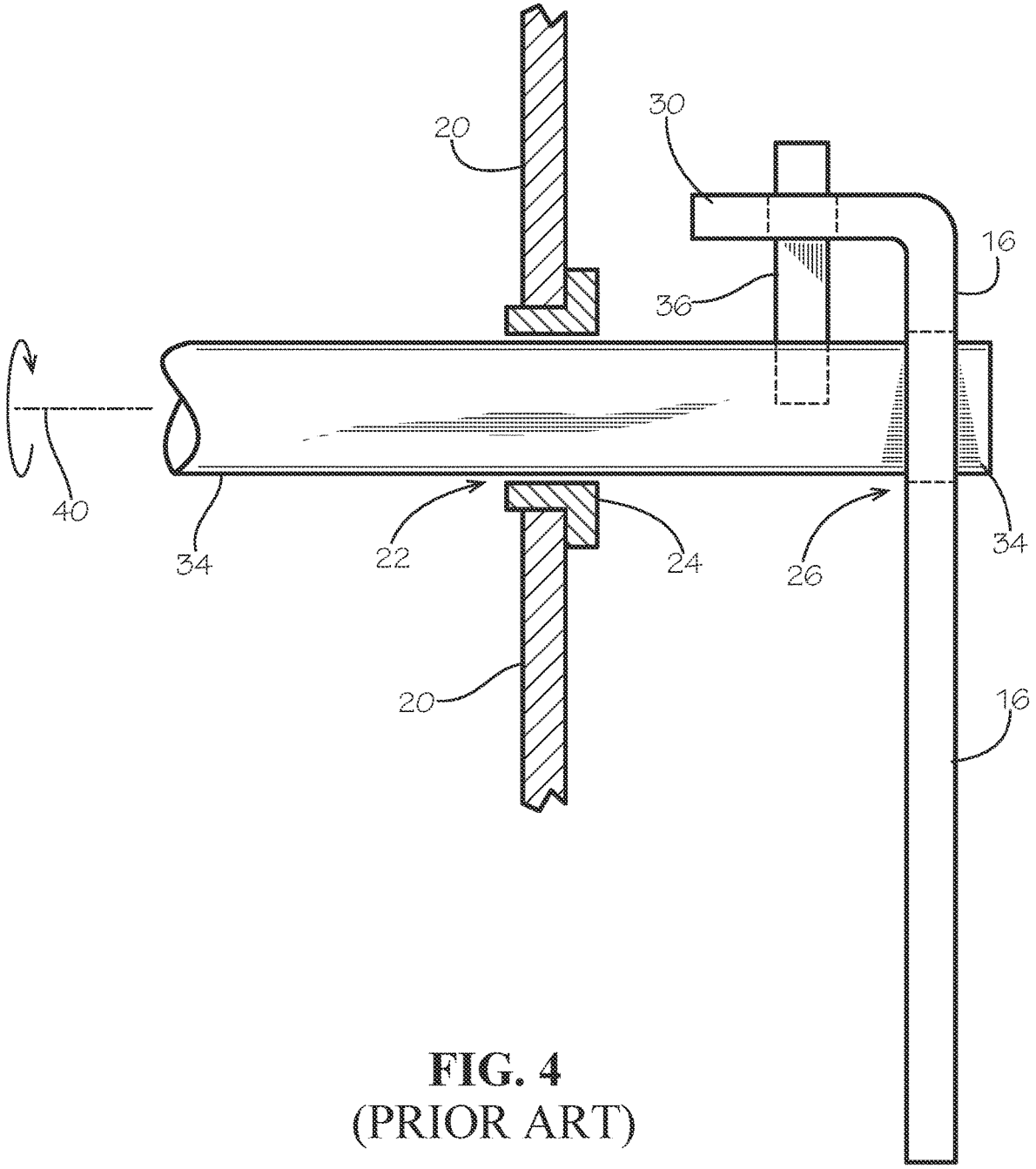
FIG. 4 (PRIOR ART)
FIG. 4 is a partial cross-sectional view showing a conventional side mechanism with a driver tube installed through the side plate into the driver arm socket.

A further example of a conventional driver arm 16 is shown in FIG. 4 in a partial cross-sectional view. Driver arm 16 includes an upper end having a ninety-degree driver arm fastener flange 30 protruding from driver arm 16. Driver arm fastener flange 30 includes a bend in the driver arm oriented toward side plate 20. When driver arm 16 is properly aligned with side plate 20, driver tube 34 may be inserted through driver tube hole 22 and also through side plate bushing 24 in conventional devices. Driver tube 34 further extends toward driver arm 16 and is received in driver arm socket 26. Once driver tube 34 is in place, a driver arm fastener 36 may be installed through driver arm fastener flange 30 to engage driver tube 34 and to hold driver tube 34 in position. From this configuration, driver tube 34 may then be rotated about driver tube axis 40 using an actuator to drive angular motion in driver arm 16 and to impart corresponding motion in swing arm 12 and additional linkages in side mechanism 10.

The present disclosure provides an improvement over the conventional side mechanisms shown in FIGS. 1-4 by allowing a pre-alignment of swing arm 12 and driver arm 16 with side plate 20 such that driver tube 34 may be directly inserted through driver tube hole 22 into driver arm socket 26 without any alignment steps being required by a worker or an automated robot. The pre-alignment is provided by a mechanical engagement between opposing bushings on driver arm 16 and side plate 20. The pre-alignment is also achieved by modifying driver arm 16 to accommodate its own driver arm bushing.

Figure 5:
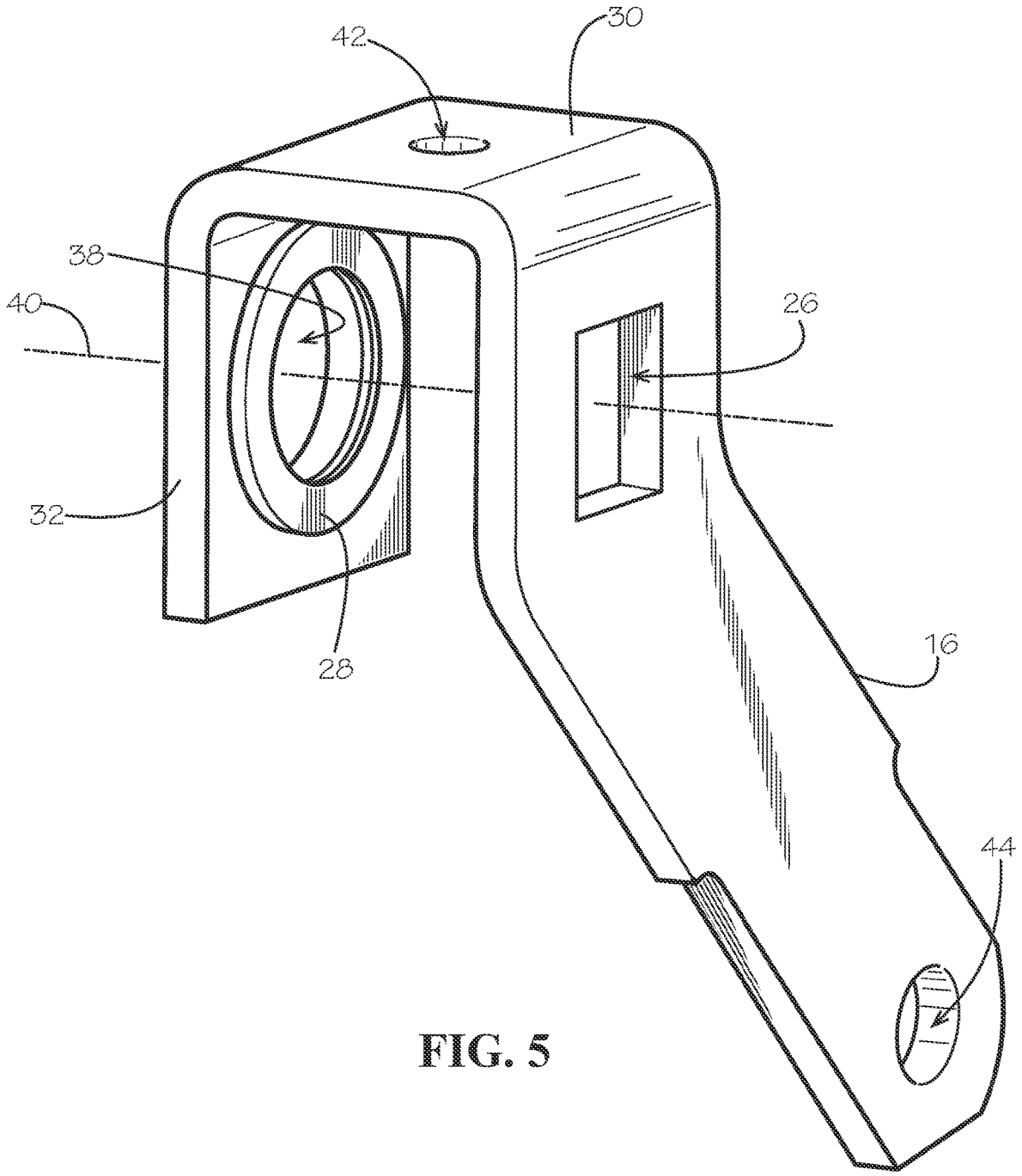
FIG. 5 is a perspective view of an embodiment of a driver arm with a driver arm bushing flange and a driver arm bushing in accordance with the present disclosure.

Referring to FIG. 5, an example of an improved driver arm 16 in accordance with the present disclosure includes a driver arm fastener flange 30 oriented at approximately ninety degrees from driver arm 16. An additional ninety degree bend is formed extending from driver arm fastener flange 30, forming driver arm bushing flange 32. Driver arm bushing flange 32 is oriented in plane substantially parallel to side plate 20 and to driver arm 16 in some embodiments. Driver arm bushing flange 32 is spaced from the body of driver arm 16, forming an inverted "U" shape on the upper end of the driver arm 16. A driver arm bushing flange hole 38 is defined through driver arm bushing flange 32 dimensioned and positioned to allow passage of driver tube 34 when driver arm 16 is properly aligned. A driver arm bushing 28 is disposed in driver arm bushing flange hole 38. Also shown in FIG. 5, a driver arm fastener flange hole 42 is defined through driver arm fastener flange 30 in some embodiments to allow passage of a driver tube fastener 36 to secure driver tube 16 in place.

Figure 6:
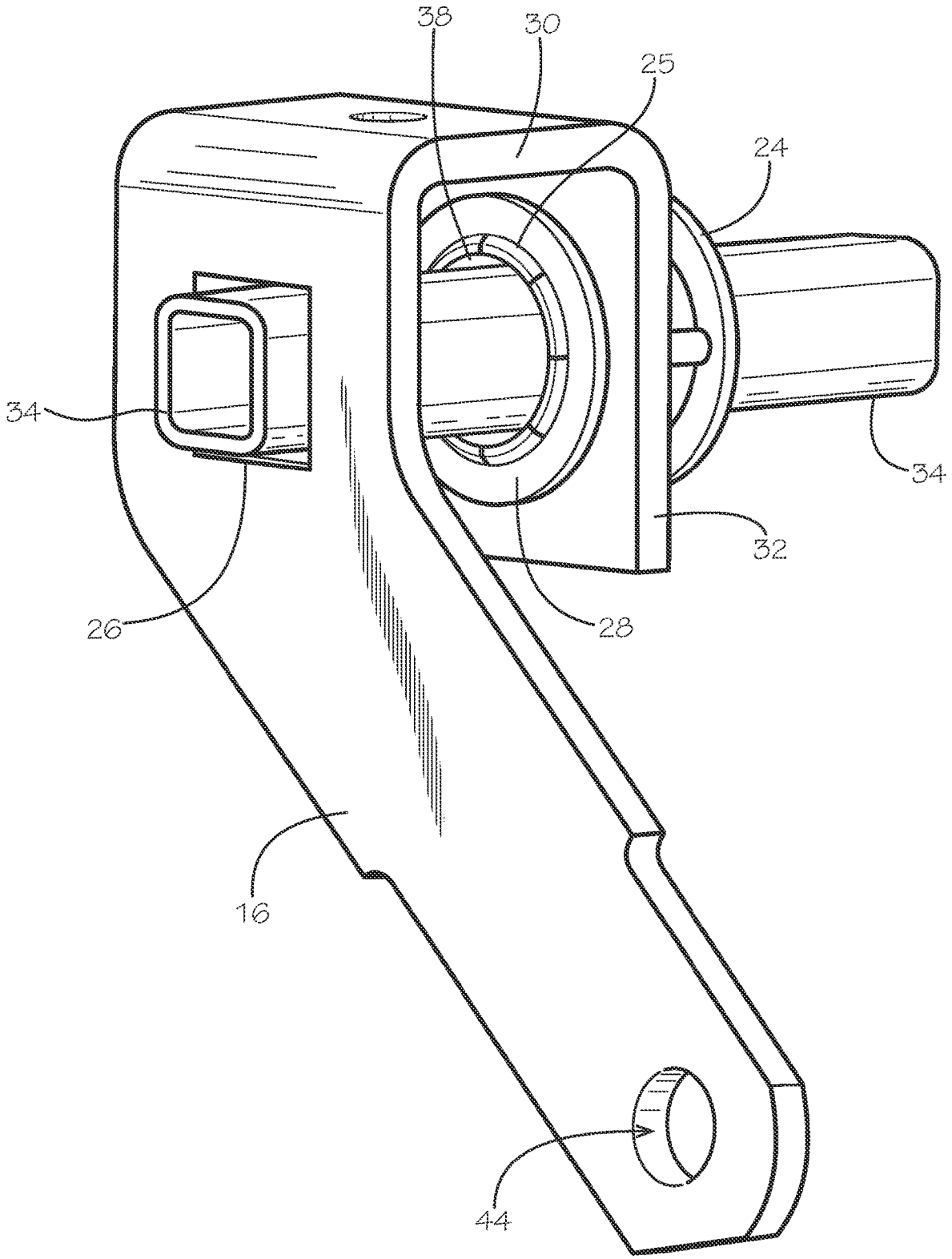
FIG. 6 is a perspective view of an embodiment of a driver arm with a driver arm bushing flange and a driver arm bushing receiving a driver tube through the driver arm bushing in accordance with the present disclosure.

Referring to FIG. 6, a driver tube 34 is received through driver arm bushing flange hole 38, and also through driver arm bushing 28. Driver tube 34 extends across the inverted "U" shaped gap on driver arm 16 into driver tube socket 26. As driver tube 34 is rotated, driver arm 16 may pivot about driver arm pivot hole 44.

Figure 7:
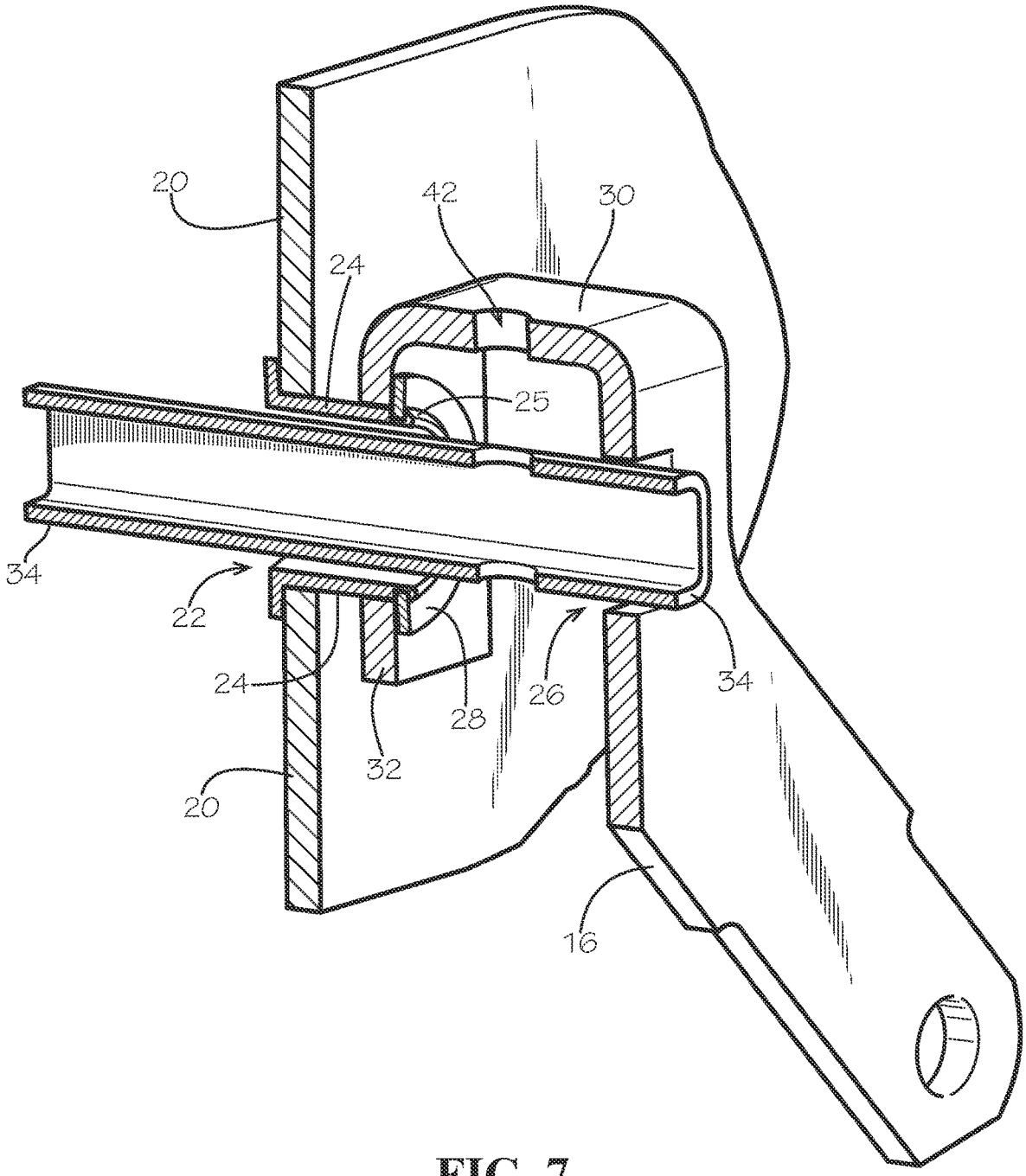
FIG. 7 is a partial cross-sectional perspective view of an embodiment of a driver arm pre-aligned beside a side plate receiving a driver tube in accordance with the present disclosure.

As seen in FIG. 6 and also in FIG. 7, driver arm bushing 28 engages a corresponding side plate bushing 24 disposed on side plate 20. The engagement between side plate bushing 24 and driver arm bushing 28 provides a mechanical alignment of driver arm 16 and swing arm 12 with side plate 20 at a desired orientation. More specifically, because side plate bushing 24 is co-axially aligned with driver arm bushing 28, and because both bushings are co-axially aligned with driver tube hole 22 and driver tube socket 26, driver tube 34 may be directly inserted through the pre-aligned assembly directly into driver tube socket 26. This alignment of both bushings spanning the gap between side plate 20 and driver arm bushing flange 32 provides a stable pre-alignment of driver arm 16 relative to side plate 20, thereby eliminating the need for a worker or an automated robot to identify any misalignment or perform any alignment step to position the driver arm 16 in an orientation that would allow driver tube 34 to extend through driver tube hole 22 into driver tube socket 34.

Figure 8:
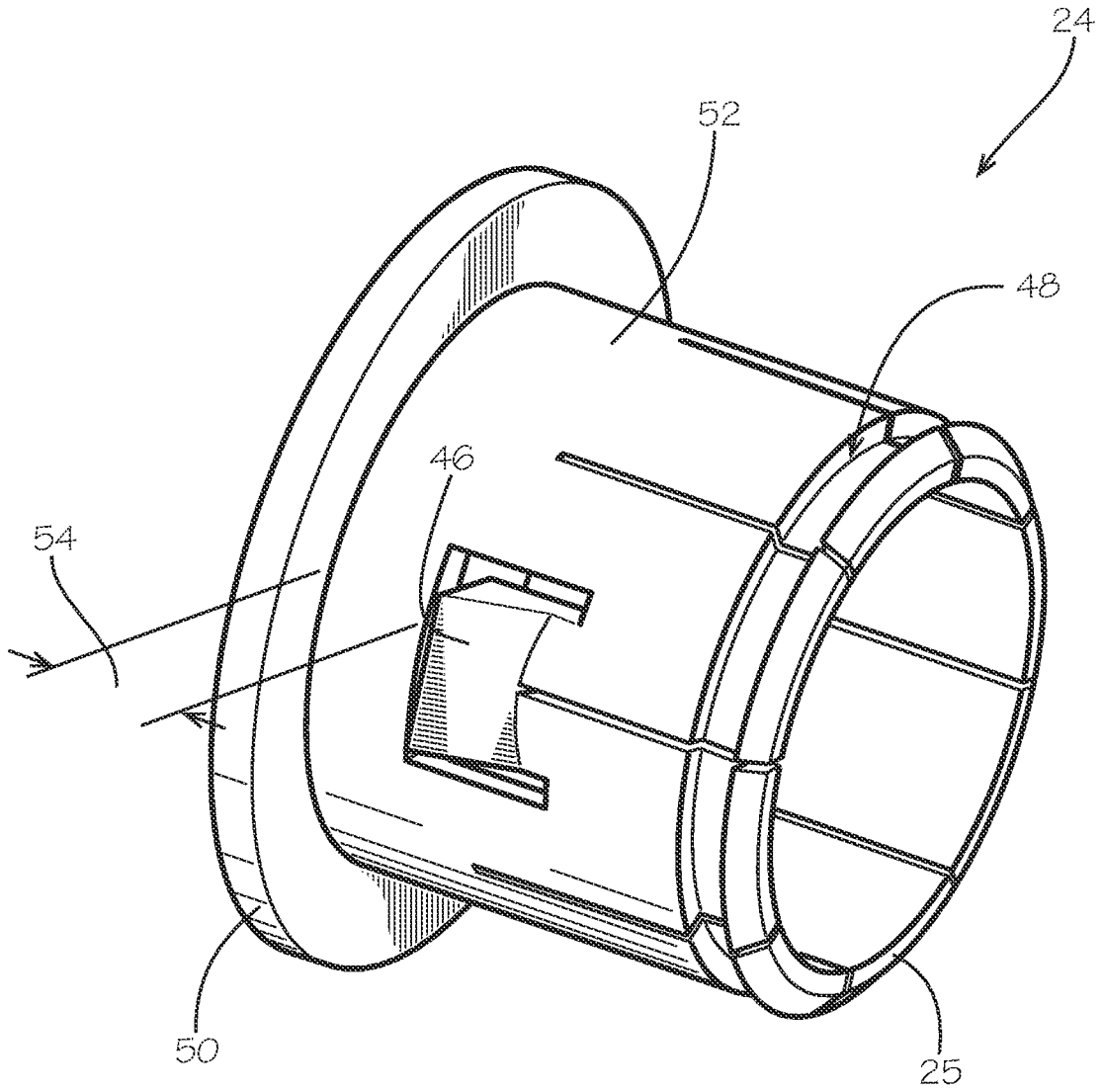
FIG. 8 is a perspective view of an embodiment of a side plate bushing in accordance with the present disclosure.

Referring further to FIG. 7 and FIG. 8, a first embodiment of a bushing assembly is shown. In the embodiment shown in FIG. 7, side plate bushing 24 includes a cylindrical body 52 passing through driver tube hole 22 toward driver arm 16. As shown in FIG. 8, side plate bushing 24 includes a rim 50 that provides an axial stop for side plate bushing 24 as it is inserted into driver tube hole 22 in side plate 20. As side plate bushing 24 is inserted into driver tube hole 22, a resilient biased ramp 46 is radially deflected inwardly toward the center axis of the bushing. Ramp 46 is axially spaced from rim 50 by a ramp spacing distance 54. The axial ramp spacing distance 54 is equal to or slightly greater than the thickness of side plate 20. This allows ramp 46 to spring back radially outwardly once the rim 50 advances axially to the side plate surface. Ramp 46 provides an anti-backing function to mechanically prevent side plate bushing 20 from inadvertently backing out of driver tube hole 22 in side plate 20.

Additionally, as seen in FIG. 8, side plate bushing 24 also includes a plurality of side plate bushing tabs 25. Each side plate bushing tab 25 may be radially deflected to allow driver arm bushing 28 to slide into side plate bushing groove 48. Once driver arm bushing 28 is received in side plate bushing groove 48, as shown in FIG. 7, the side plate bushing tabs 25 snap back and retain the driver arm bushing 28 in place, thereby securing the pre-alignment of driver arm 16 relative to side plate 20. As such, the bushings form a mechanical retainer.

Figure 9:
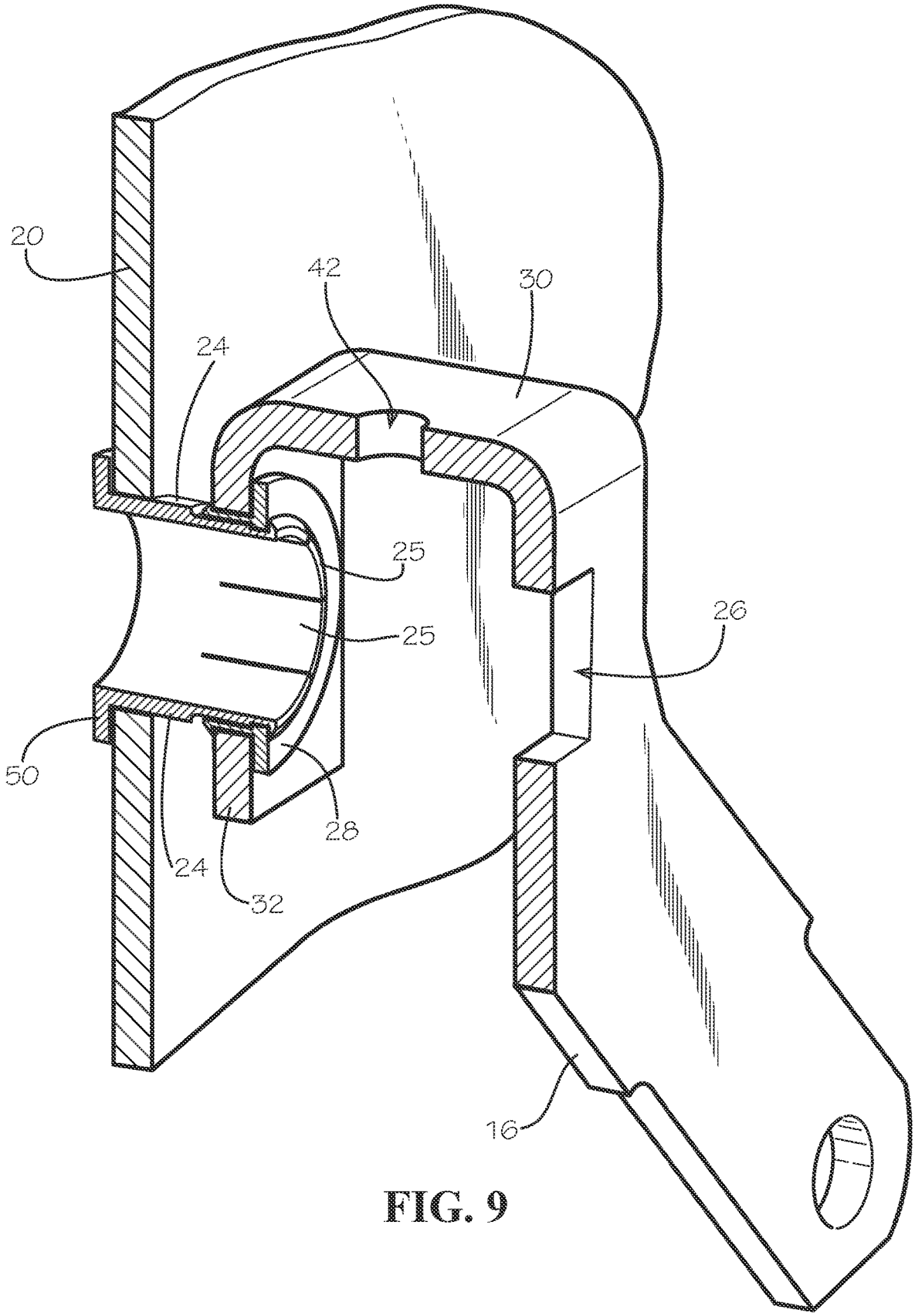
FIG. 9 is a partial cross-sectional perspective view of an embodiment of a driver arm pre-aligned beside a side plate positioned to receive a driver tube in accordance with the present disclosure.
Figure 10:
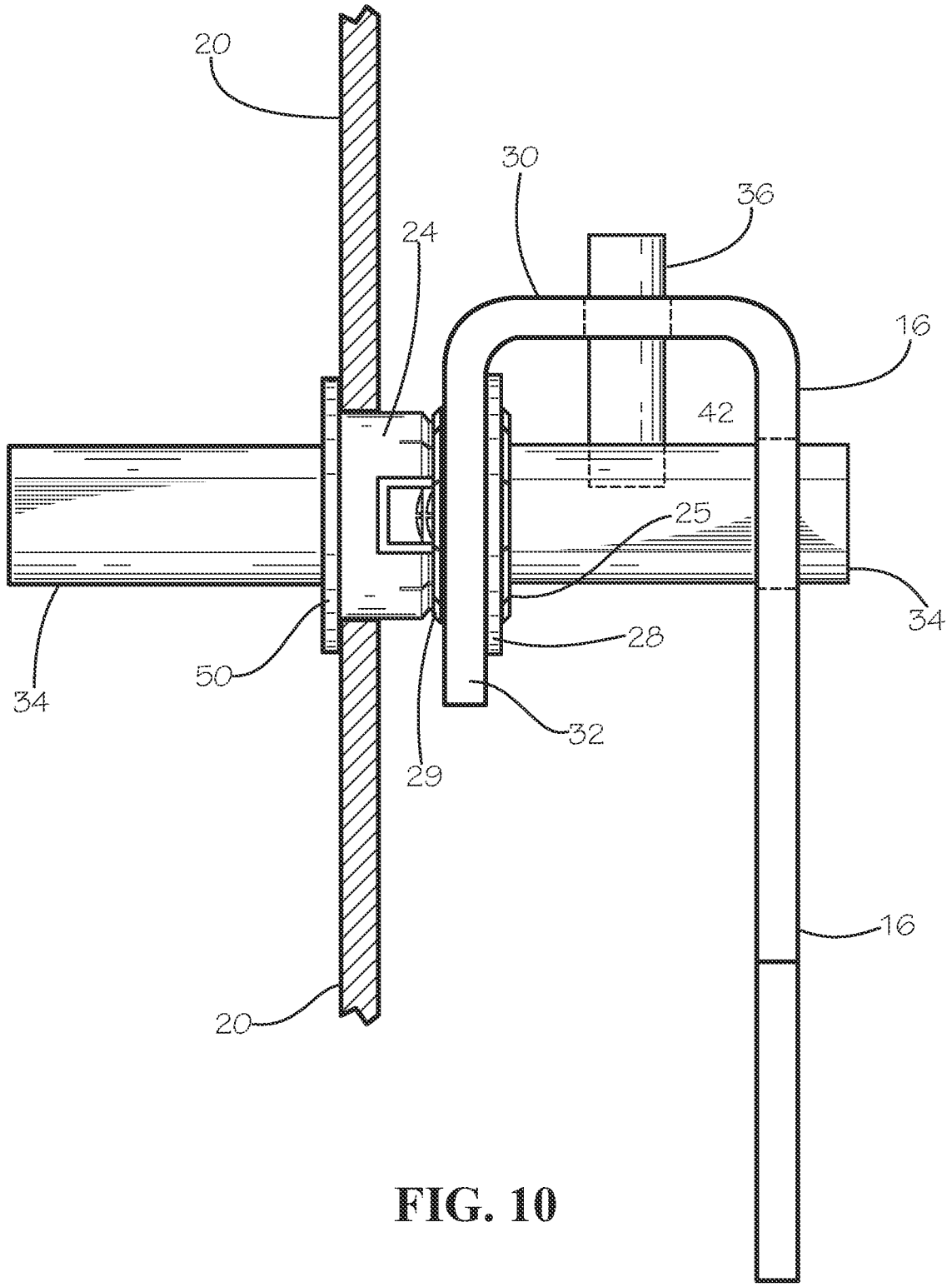
FIG. 10 is a partial cross-sectional view of an embodiment of a driver arm pre-aligned beside a side plate positioned to receive a driver tube in accordance with the present disclosure.

In the first embodiment shown in FIG. 7 and FIG. 8, the driver arm bushing 28 takes the shape of a flat washer positioned against the inside surface of driver arm bushing flange 32. However, in a second embodiment, driver arm bushing 28 may take an alternative shape similar to the tubular shape of side plate bushing 24, but oriented in the opposite direction. For example, as shown in FIG. 9 and FIG. 10, side plate bushing 24 includes a similar cylindrical body having rim 50 and side plate bushing tabs 25. Driver arm bushing 28 also includes a cylindrical body extending through the thickness of driver arm bushing flange 32. Driver arm bushing 28 also includes a rim to provide an axial stop for driver arm bushing 28. In this embodiment, driver arm bushing 28 is co-axially aligned with side plate bushing 24 and forms a sleeve around the outer surface of side plate bushing 24 as it passes through driver arm bushing flange 32. As shown in FIG. 10, in some embodiments, driver arm bushing 28 includes one or more resilient driver arm bushing tabs 29 on the outer side of driver arm bushing flange 32. The driver arm bushing tabs 29 help to retain driver arm bushing 28 in its desired axial position passing through driver arm bushing flange 32. In other words, driver arm bushing tabs 29 prevent driver arm bushing 28 from inadvertently backing out of the driver arm bushing flange during use. The portion of driver arm bushing 28 forming a sleeve around side plate bushing 24 is received in the side plate bushing groove 48.

As shown in FIG. 9, the bushing engagement between side plate bushing 24 and driver arm bushing 28 provides a mechanical retainer that keeps driver arm 16 and swing arm 12 in proper alignment for installation of driver tube 34. This means an automated robot or a worker may position the opposing side mechanisms and immediately insert the driver tube once the side mechanisms are in place without having to perform any alignment step relating to swing arm 12 or driver arm 16. Side bushing 24 and driver arm bushing 28 snap together prior to delivery of the side mechanism to the assembly line. Thus, when the side mechanism is delivered for assembly, the swing arm and driver arm are already aligned for driver tube insertion.

Thus, although there have been described particular embodiments of the present invention of a new and useful MOTION FURNITURE MECHANISM WITH PRE-ALIGNED LINKAGE MEMBER, it is not intended that such references to particular embodiments be construed as limitations upon the scope of this invention.

What is claimed is:

1. A method of assembling furniture, comprising:

providing a side mechanism having a side plate and a pivotable swing arm, a driver arm disposed on the swing arm, a driver tube socket defined in the driver arm, a driver tube hole defined in the side plate, wherein the driver tube socket on the driver arm is pre-aligned with the driver tube hole on the side plate;

providing a driver tube for insertion into the driver tube socket through the driver tube hole;

aligning the driver tube with the driver tube hole in the side plate; and inserting the driver tube through the driver tube hole in the side plate, through a side plate bushing on the side plate, through a driver arm bushing on the driver arm, and into the driver tube socket, wherein the side plate bushing and the driver arm bushing engage each other and align the driver tube hole and the driver tube socket.

2. The method of claim 1, wherein the side mechanism further comprises the side plate bushing disposed in the driver tube hole.

3. The method of claim 2, wherein the side mechanism further comprises the driver arm bushing disposed on the driver arm.

4. The method of claim 3, wherein the side plate bushing and the driver arm bushing are co-axially aligned.

5. The method of claim 4, wherein the driver arm bushing forms a sleeve around a portion of the side plate bushing.

* * * * *